United States Patent [19]

Selinko

[11] Patent Number: 4,858,795

[45] Date of Patent: Aug. 22, 1989

[54] DEVICE FOR AIDING IN THE PUTTING ON OF STOCKINGS OR THE LIKE

[76] Inventor: George J. Selinko, 2021 N.E. 31st Ct., Lighthouse Point, Fla. 33064

[21] Appl. No.: 186,592

[22] Filed: Apr. 27, 1988

[51] Int. Cl.[4] ..... A47G 25/90

[52] U.S. Cl. ..... 223/111

[58] Field of Search ..... 223/111, 112, 118

[56] References Cited

U.S. PATENT DOCUMENTS

| | | | |
|---|---|---|---|
| 1,141,777 | 6/1915 | Coulston | 223/112 |
| 1,213,948 | 1/1917 | Redheffer | 223/118 |
| 2,366,097 | 12/1944 | Gesell | 223/118 |
| 3,310,209 | 3/1967 | Clauss | 223/111 |
| 3,452,907 | 7/1969 | MacLauchlan | 223/111 |
| 3,515,320 | 6/1970 | Wintersberger | 223/111 |
| 3,853,252 | 12/1974 | Scianimanico | 223/111 |
| 4,260,083 | 4/1981 | Aslin | 223/111 |
| 4,620,737 | 11/1986 | Sanger | 223/111 X |
| 4,637,532 | 1/1987 | Doorenbos | 223/112 X |
| 4,637,533 | 1/1987 | Black | 223/112 |
| 4,651,909 | 3/1987 | Banting | 223/111 |

FOREIGN PATENT DOCUMENTS

| | | | |
|---|---|---|---|
| 3423150 | 1/1986 | Fed. Rep. of Germany | 223/111 |
| 2340708 | 9/1977 | France | 223/112 |

*Primary Examiner*—Robert R. Mackey

*Attorney, Agent, or Firm*—Winfield J. Brown, Jr.

[57] ABSTRACT

A device to aid an individual in putting on an elastic stocking. The device includes a member with a slidable surface. The member has a U-shaped portion on a front end extending into a flat base portion on the back end. The U-shaped portion has opposed side walls extending upwardly from a flat bottom base. A stocking is bunched up and slid over the front end and onto the side walls to form a cavity for inserting a first foot of the individual. The second foot exerts pressure on the flat base portion while the first foot slides along the flat base portion and into the stocking cavity. The stocking slides off the side walls and the front end as the first foot is slid forward. In the process the stocking is slid on the first foot of the individual.

12 Claims, 2 Drawing Sheets

SECTION 6-6

DEVICE FOR AIDING IN THE PUTTING ON OF STOCKINGS OR THE LIKE

BACKGROUND OF THE INVENTION

FIELD OF THE INVENTION

This invention relates to a device and method to assist in the putting on of stockings or similar leg coverings and, more particularly, to a device which can be used to insert the foot into the stocking without the user bending over.

Many people because of some disability have difficulty in putting socks or stockings on their feet. This problem is particularly noticeable in the use of elastic stockings which are used for solving circulatory problems. This disability is also evident in cases where an individual is not able to bend over far enough due to a medical disability or the like to initially put on the stocking and pull on the sock or stocking.

In the past there have been many proposals to ease the problem for an individual unable to bend. Most of these involve the use of extensions for the arms of the user either by handles, some sort of pulling device or by using straps or garter like mechanism to allow the user to exert pulling forces on the tops of the stockings. Examples of these devices are shown in U.S. Pat. No. 3,310,209 to Clauss, U.S. Pat. No. 3,401,856 to Berlin, U.S. Pat. No. 3,452,907 to MacLaughlan, U.S. Pat. No. 3,853,252 to Scianimanico, U.S. Pat. No. 4,260,083 to Aslin, U.S. Pat. No. 4,620,737 to Sanger and U.S. Pat. No. 4,651,909 to Banting. In general, all of these devices require the individual to initially bend down to insert the stocking on the foot. Therefore, it would be extremely desirable to provide a device that inserts the stocking on the foot without requiring the individual to bend.

SUMMARY OF THE INVENTION

The present invention is provided for eliminating the problems with the prior art devices. Therefore, in accordance with the present invention, there is provided a device and method for aiding an individual for putting on stockings without requiring the individual to bend at the waist.

An advantage of the present invention is to provide an apparatus for initially putting on a stocking which only requires the individual to use his feet.

Another advantage of the present invention is to provide a lightweight portable device that can be easily folded and carried to aid an individual for putting on a stocking. These as well as other advantages of the present invention will be in part apparent and in part pointed out hereinafter.

In general, a device for aiding in putting on of a stocking comprises a member with a slidable surface and having a U-shaped portion on a front end extending in to a flat base portion on the back end. The U-shaped portion having a flat bottom base is connected to opposed side walls extending upwardly from the flat bottom base of the U-shaped portion.

In operation, a bunched up stocking is slid over the front end of the U-shaped portion over the side walls as deep as the top of the sock to form a cavity in the sock for inserting a first foot. The second foot exerts a force on the flat based portion of the back end by stepping on it to prevent the device from sliding when the first foot is slid from the back end over the flat base portion to the flat bottomed base of the U-shaped portion into the stocking cavity. This causes the first foot to engage the stocking cavity and to roll off the device as the first foot moves to the forward end. After the first foot is inserted into the sock cavity and rolled off the device, the sock can be pulled up onto the leg or straps previously attached on the sides of the stockings permit the individual to pull up the stockings on the leg allowing the individual to remain in a erect posture.

In a second embodiment, a hinge is placed between the flat bottomed base and the flat based portion to permit the device to be easily folded into a compact carrying form.

DETAILED DESCRIPTION OF AN ILLUSTRATED EMBODIMENT

In order to best illustrate the utility of the present invention, the invention is described in conjunction with a stocking, typically an elastic stocking. However, it is understood that the device and method described herein can be used with other stockings such as socks or the like.

Figure 1:
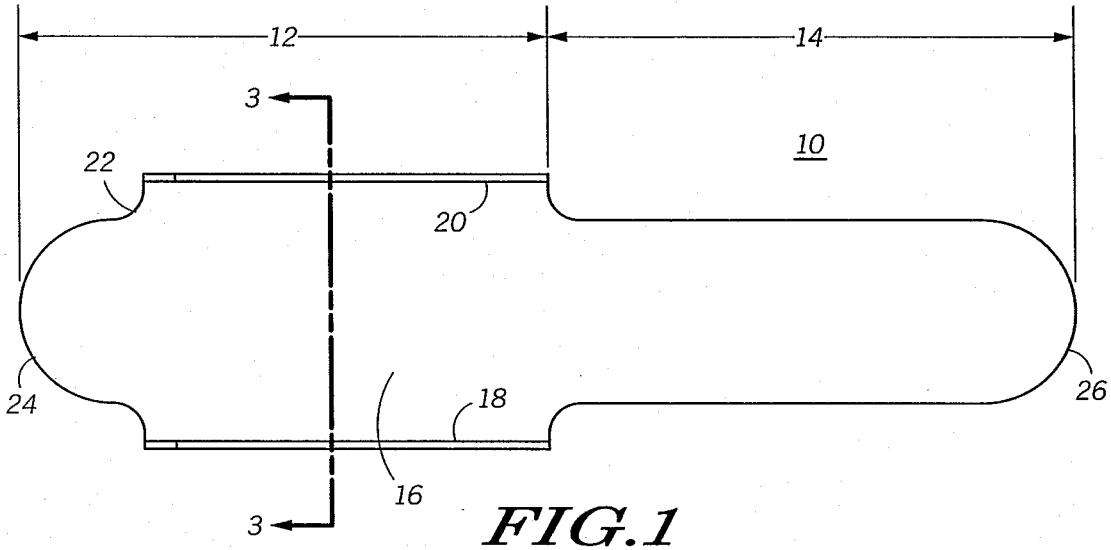
FIG. 1 is a top view of the device according to the present invention.

Referring to FIG. 1 there is shown a first embodiment for a device 10 for aiding an individual for putting on stockings. Device 10 is comprised of a member with a slidable surface and having a U-shaped portion illustrated as 12 and a flat base portion illustrated as 14. It is noted that the slidable surface extends over the U-shaped portion 12 and flat base portion 14. U-shaped portion 12 includes a flat bottom base 16 having opposed side walls 18 and 20 extending upwardly from the flat bottom base 16. The combination of the flat bottom base 16 and upwardly extending side walls 18 and 20 form U-shaped portion 12 when viewed along line 3—3. The front end 22 of U-shaped portion 12 includes an outwardly extending protrusion 24 to ease insertion of the stocking on the U-shaped portion 12. U-shaped portion 12 is connected and extends into a flat base portion 14. The over all length of the device 10 is designed so that one foot of the individual may rest on the flat base portion 14 while the other foot easily slides along the flat base portion 14 over the flat bottom base 16 towards the front end 22.

Figure 2:
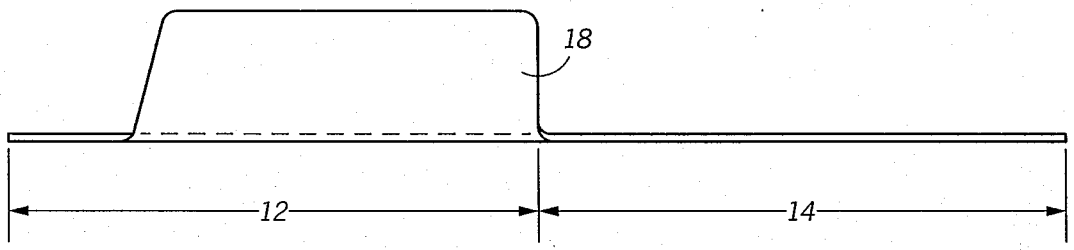
FIG. 2 is a side view of the device illustrating the extending side walls.

Referring now to FIG. 2, there is shown a side view of device 10. As is illustrated, the side wall 18 extends upwardly from the flat bottom base 16. The edges of side wall 18 are rounded to prevent an injury to the individual's foot. Towards the front end of side wall 18, the side walls extend at an angle of approximately 15 degrees from the vertical to ease the stocking over the side walls of the device.

Figure 3:
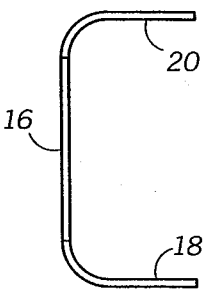
FIG. 3 is a sectional view taken along line 3—3 of FIG. 1.

Referring now to FIG. 3, there is shown a sectional view of FIG. 1 taken along line 3—3. As is illustrated, the side walls 18 and 20 extend upwardly from the flat bottom base of 16. The width of the U-shaped portion is designed to comfortably accept the foot of the individual and can be different widths to accept different foot widths.

In operation, the individual takes the stocking and bunches it up and inserts it on the front end 22 of the device 10 pulling the stocking to the back end 26 of the side walls to form a cavity at the back end 26 of the side walls. The individual places the second foot on the flat base portion 14 and slides the first foot into the cavity formed by the sock opening, side walls 18 and 20 and the flat bottom base 16. The individual slides the first foot forward towards the front end of the device permitting the stocking to unroll off the device 10 and to be inserted on the foot. With the foot initially inserted into the stocking, the individual can pull the stocking up with the hands or by attaching straps to the side of the stockings can pull on the straps to unroll the stocking up on the leg. The device may be made of metal such as aluminum or may be made out of pliable material such as plastic, nylon, acetal, ABS plastic, polypropylene, or polycarbonate in a manner well known to those of ordinary skill in the art.

Figure 4:
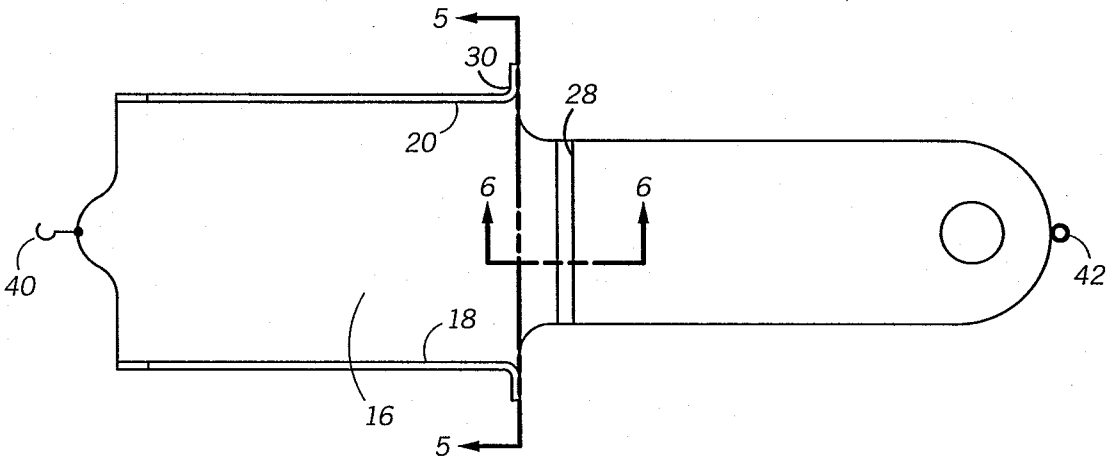
FIG. 4 is a top view of a second embodiment of the device according to the present invention illustrating a method for folding the device to allow the individual to carry the device.

Referring now to FIG. 4, a second embodiment of the present invention includes a living hinge 28 to permit the flat base portion 14 to fold over on to the flat bottom base 16 to decrease the overall length of the device to facilitate the packaging of the device for travel or other means. The living hinge 28 can be made of different material than the rest of the device. For example, the hinge 28 can be made of polypropylene, while the rest of the device is made of nylon. It is understood that the device of the first or second embodiment can be made by conventional molding techniques well known in the art.

Additionally, stop tabs 30 and 32 can be added to prevent the stocking from slipping over the back end of side walls 18 and 20. However, it is noted that tabs 30 and 32 are not needed for proper operation of the device.

Figure 5:
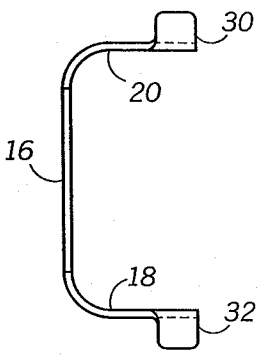
FIG. 5 is a sectional view taken along line 5—5 illustrating the extending tabs.

Referring to FIG. 5, there is shown a sectional view taken along line 5—5 of FIG. 4. As is evident from FIG. 5, tabs 30 and 32 extend outward from side walls 18 and 20 to prevent the stocking from sliding don the back end of the side walls.

Figure 7:
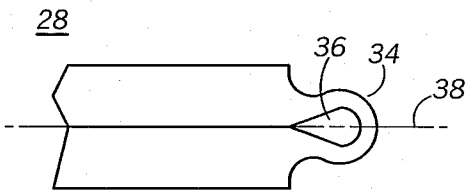
FIG. 7 illustrates how the device can be folded about the living hinge.
Figure 6:
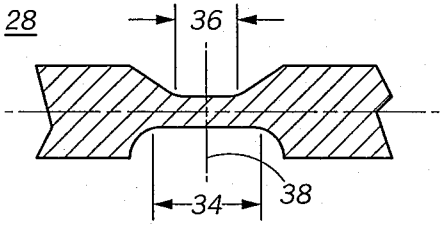
FIG. 6 is a close up side view of FIG. 4 along line 6—6 showing a living hinge to permit the device to be folded.

Referring to FIG. 6, the shape of the living hinge 28 is shown. The cut out sections 34 and 36 are designed to permit the hinge to be folded about center line 38. As shown in FIG. 7, the shape of the hinge 28 permits flat base portion 14 to fold over onto the flat bottom base 16. As stated before, the living hinge can be formed by molding a pliable material such as polypropylene.

Referring briefly back to FIG. 4, an attaching means such as a hook 40 and eye 42 can be installed to prevent the device from unfolding, the hook 40 being attached to either the front or back end and the eye 42 being attached to the opposite end. The hook 40 and eye 42 can also be made of pliable material.

Thus, there has been shown a method and device for aiding an individual for putting on of stockings or the like. The device comprises a member with a slidable surface having a U-shaped portion on a first end extending into a flat base portion on the back end. The U-shaped portion has a flat bottom base connected to opposed side walls extending upwardly from the flat bottom base of the U-shaped portion. In use, a bunched up stocking is slid over the front end of the side walls to form a cavity for inserting a first foot. The second foot is placed on the flat base portion to allow the first foot to be slid along the member into the stocking cavity to permit the stocking to roll up on the foot of the individual.

The above described embodiments of the invention are illustrative only and modifications may occur to those skilled in the art. Accordingly, this invention is not to be regarded as limited to the embodiment enclosed herein, but is to be limited as defined by the appended claims.

I claim:

1. A device for aiding the putting on of a stocking comprising:

a member having a slidable surface and including a U-shaped portion on a front end extending into a flat base portion on the back end, said member further having an outwardly extending protrusion on the front end, said U-shaped portion having a flat bottom base connected to opposed side walls extending upwardly from said flat bottom base of said U-shaped portion, said flat base portion lying within the same plane as the flat bottom base to form a continuously smooth unitary-bottom surface, said sidewalls and said flat bottom base having substantially smooth-exterior surfaces to permit a stocking to easily slide over the surfaces, wherein a bunched up stocking is easily slidable over the outwardly extending protrusion on said front end over said side walls forming a cavity for inserting a first foot, and further wherein said U-shaped portion remains stationary due to pressure exerted by the second foot on said flat base portion to permit the first foot to slide over the bottom base and into the stocking cavity, said substantially smooth-exterior surfaces permitting the stocking to easily slide off the U-shaped portion onto the first foot to aid the individual in putting on the stocking.

2. The device of claim 1, wherein said member is made from a pliable plastic material.

3. The device of claim 2, wherein said pliable plastic material is polypropylene.

4. The device of claim 2, wherein said pliable plastic material is nylon.

5. The device of claim 1, wherein said flat base portion includes a living hinge to allow said flat base portion to be folded up onto said flat bottom base to effectively decrease the overall length of the device.

6. The device of claim 5, wherein each of said opposed side walls includes an outwardly extending tab connected to the back end of said U-shaped portion, said tabs preventing the stocking from sliding over the ends of each said opposed side walls.

7. The device of claim 5, wherein said living hinge is made of polypropylene.

8. A device for aiding the putting on of a stocking comprising:

a member having a slidable surface and including a U-shaped portion on a front end extending into a flat base portion on the back end, said member further having a outwardly extending protrusion on the front end to permit a stocking to be easily inserted onto the member, said U-shaped portion having a flat bottom base connected to opposed side walls extending upwardly from said flat bottom base of said U-shaped portion, said flat base portion lying within the same plane as the flat bottom base to form a continuously smooth unitary-bottom surface, said sidewalls and said flat bottom base having substantially smooth-exterior surfaces to permit a stocking to easily slide over the surfaces, said member further including a hinge positioned between the U-hinged portion and the flat base portion, said hinge permitting said flat base portion to be folded onto said U-shaped portion to reduce the overall length of said member.

9. The device of claim 8, wherein said member is made of a pliable material.

10. The device of claim 9, wherein said hinge is made of polypropylene.

11. The device of claim 10, wherein said member is made of nylon.

12. The device of claim 8, further including an attaching means for holding said flat base portion onto said U-shaped portion when said member is folded.

* * * * *